US010208945B1

(12) United States Patent
Lan

(10) Patent No.: US 10,208,945 B1
(45) Date of Patent: Feb. 19, 2019

(54) LED LIGHT

(71) Applicant: Shenzhen Guanke Technologies Co., Ltd., Shenzhen (CN)

(72) Inventor: Qing Lan, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 15/669,959

(22) Filed: Aug. 6, 2017

(30) Foreign Application Priority Data

Jul. 25, 2017 (CN) ..... 2017 1 0610722

(51) Int. Cl.

| | |
|---|---|
| ***F21V 29/76*** | (2015.01) |
| ***F21V 29/83*** | (2015.01) |
| ***F21V 23/06*** | (2006.01) |
| ***F21V 3/02*** | (2006.01) |
| ***F21K 9/20*** | (2016.01) |
| ***F21V 23/02*** | (2006.01) |
| ***F21V 3/06*** | (2018.01) |
| *F21Y 115/10* | (2016.01) |

(52) U.S. Cl.
CPC ..... *F21V 29/76* (2015.01); *F21K 9/20* (2016.08); *F21V 3/02* (2013.01); *F21V 3/062* (2018.02); *F21V 23/02* (2013.01); *F21V 23/06* (2013.01); *F21V 29/83* (2015.01); *F21Y 2115/10* (2016.08)

(58) Field of Classification Search
CPC ..... F21V 29/70; F21V 29/74; F21V 29/745; F21V 29/75; F21V 29/76; F21V 29/763; F21V 29/767; F21V 29/83; F21V 23/00; F21V 23/06; F21K 9/20; F21K 9/237; F21K 9/238; F21Y 2115/10; F21Y 2103/33; F21Y 2105/18
See application file for complete search history.

(56) References Cited

U.S. PATENT DOCUMENTS

| | | | | |
|---|---|---|---|---|
| 8,764,244 | B2 * | 7/2014 | Jeon | F21S 2/005 362/218 |
| 9,212,791 | B2 * | 12/2015 | Kim | F21V 19/045 |
| 2013/0170207 | A1 * | 7/2013 | Garcia | F21V 29/773 362/238 |
| 2013/0200796 | A1 * | 8/2013 | Song | F21V 29/83 315/113 |

(Continued)

*Primary Examiner* — Thien M Le
*Assistant Examiner* — April Taylor

(57) ABSTRACT

An LED light includes a housing, a first luminous portion surrounded around the housing, a second luminous portion positioned below the first luminous portion, a heat sink positioned between the first and second luminous portions, a power supply received in the housing and a holder. The holder, the power supply, the first luminous portion and the second luminous portion are electrically connected to form a circuit branch. When the first luminous portion gives out light towards a first direction, the second luminous portion gives out light towards a second direction which is opposite to the first direction. The first and second luminous portions are respectively mounted on the corresponding upper and bottom sides of the heat sink to ensure the LED light simultaneously give out lights towards up and down, meanwhile, the heat sink is positioned between the first and second luminous portions to improve heat dissipation effects and the lifespan of the LED light.

20 Claims, 5 Drawing Sheets

(56) References Cited

U.S. PATENT DOCUMENTS

| | | | | |
|---|---|---|---|---|
| 2014/0078723 | A1* | 3/2014 | Chen | F21V 23/023 362/184 |
| 2016/0161102 | A1* | 6/2016 | Chou | F21V 29/773 362/249.02 |
| 2018/0023796 | A1* | 1/2018 | Jiang | F21V 29/83 362/249.02 |

* cited by examiner

LED LIGHT

BACKGROUND

1. Technical Field

The present disclosure generally relates to light sources field, and especially relates to a Light-Emitting Diode (LED) light used in a parking lot or a garage.

2. Description of Related Art

It is well known that the illuminations used in parking lots or garages not only need to illuminate the floor, but also need to illuminate the ceiling. However, the traditional illuminations used in the parking lots or garages are HID lamps (xenon lamps) which are characterized by low luminous power, high energy-consumption, poor heat dissipation and short lifespan.

LED lights are used in various fields such as display devices, decorations, backlights, parking lots/garages and illuminations which are characterized by non-pollution, energy-saving, long lifespan and small in size. Such LED light, a high intensity of illumination can be obtained with a less amount of electric power and its lifespan reaches over three years without any particular repair, thereby providing a possibility and potentiality as a future illumination light.

In general, the maximum light angle of a typical LED light is 120 degree. In order to obtain uniform light and adjustable light angles, the light angle of the ordinary LED light is designed for two types: one type is 180 degree, the other type is 360 degree. Such type of the light angle is too single to be suitable for lighting appliances as parking lots or garages, thereby it is needed to design new LED lights for being used in parking lots or garages.

SUMMARY

The disclosure relates to an LED light which may simultaneously give out lights towards up and down and provide the heat sink positioned between the first and second luminous portions to improve heat dissipation effects and the lifespan of the LED light so as to replace the traditional HID lamp (xenon lamp) as a lighting appliance for parking lots and garages.

In one aspect, an LED light includes: a housing, a first luminous portion surrounding around the housing, a second luminous portion positioned below the first luminous portion, a heat sink positioned between the first luminous portion and the second luminous portion, a power supply received in the housing, and a holder electrically connecting to the power supply. The holder, the power supply, the first luminous portion and the second luminous portion are electrically connected to form a circuit branch. When the first luminous portion gives out light towards a first direction, the second luminous portion gives out light towards a second direction which is opposite to the first direction.

Wherein the first direction is vertical upward and the second direction is vertical downward.

Wherein the heat sink includes a plurality of cooling fins vertically positioned between the first luminous portion and the second luminous portion, and a supporter positioned between the plurality of cooling fins, the supporter and the plurality of cooling fins surround to form a cylinder.

Wherein the supporter is hollow inside configuration and a channel is formed therethrough, the two opposite ports of the supporter in the horizontal direction are unclosed so as to allow air to enter the supporter from the horizontal direction; the plurality of cooling fins is formed parallel to each other, the length of the plurality of cooling fins are different and a passageway is formed between every two adjacent cooling fins.

Wherein the first luminous portion is circular ring configuration and includes a first baseboard mounted on the supporter, a first light plate, with circular ring shaped, tightly connected with the first baseboard, and a first lampshade tightly connected with the first baseboard and covered on the first light plate. The first light plate includes a plurality of first LEDs which emits light and generates heat when the first luminous portion is powered on; and the first lampshade is a polycarbonates (PC) transparent material and circular ring configuration.

Wherein the housing includes a body and a cover tightly connected with the body, and a receiving room formed between the body and the cover for receiving the power supply therein, the bottom of the cover extends downward along the second direction to form a main post which tightly connects with the supporter.

Wherein the first light plate includes an inserting portion inserted into the main post to electrically connect with the power supply, the main post includes a wiring post passing through the heat sink to electrically connect the second luminous portion with the power supply via the wiring post.

Wherein the second luminous portion includes a second baseboard tightly connected with the supporter and the plurality of cooling fins, a third baseboard tightly connected with the supporter and the plurality of cooling fins, a second light plate tightly mounted on the second baseboard, and a third light plate tightly mounted on the third baseboard. Both the second light plate and the third light plate are circular ring configuration and the third light plate comprises a plurality of second LEDs.

Wherein the third baseboard surrounds around the second baseboard and a first gap is formed between the second baseboard and the third baseboard.

Wherein the second luminous portion further includes a second lampshade made from polycarbonates (PC) transparent material, the second lampshade tightly mounted on the second baseboard and the third baseboard to cover on the second light plate and third light plate.

Wherein the second lampshade includes a plurality of connecting strips and a second gap is formed between the plurality of connecting strips, the connecting strip corresponds to the first gap which is formed between the second baseboard and the third baseboard when the second lampshade covers on both the second and third light plates.

Wherein the second lampshade is integrated configuration and includes a plurality of sliding recesses used for tightly connecting the second lampshade and the second baseboard.

In another aspect, an LED light according to an exemplary embodiment of the present disclosure includes a housing, a first luminous portion surrounded around the housing, a second luminous portion positioned below the first luminous portion, a heat sink positioned between the first luminous portion and the second luminous portion, a power supply received in the housing, and a holder electrically connected with the power supply. The first luminous portion is positioned on the upper portion of the heat sink and the second luminous portion is positioned on the bottom portion of the heat sink. The holder, the power supply, the first luminous portion and the second luminous portion are electrically connected to form a circuit branch. When the first luminous portion gives out light towards a vertical upward direction to surround around the housing, the second luminous portion gives out light towards a vertical downward direction which is opposite to the vertical upward direction.

Wherein the heat sink includes a plurality of cooling fins vertically positioned between the first luminous portion and the second luminous portion, and a supporter positioned between the plurality of cooling fins, the supporter and the plurality of cooling fins surround to form a cylinder; the supporter is hollow inside configuration and a channel is formed therethrough, the two opposite ports of the supporter in the horizontal direction are unclosed so as to allow air to enter the supporter from the horizontal direction; the plurality of cooling fins are formed parallel to each other, the length of the plurality of cooling fins are different and a passageway is formed between every two adjacent cooling fins.

Wherein the first luminous portion is circular ring configuration and includes a first baseboard mounted on the supporter, a first light plate, with circular ring shaped, tightly connected with the first baseboard, and a first lampshade tightly connected with the first baseboard to cover on the first light plate. The first light plate includes a plurality of first LEDs which emits light and generates heat when the first luminous portion is powered on, and the first lampshade is a polycarbonates (PC) transparent material and circular ring configuration.

Wherein the second luminous portion includes a second baseboard tightly connected with the supporter and the plurality of cooling fins, a third baseboard tightly connected with the supporter and the plurality of cooling fins, a second light plate tightly mounted on the second baseboard, and a third light plate tightly mounted on the third baseboard. Both the second and third light plates are circular ring configuration and the third light plate includes a plurality of second LEDs; the third baseboard surrounds around the second baseboard and a first gap is formed between the second and third baseboards.

Wherein the housing includes a body and a cover tightly connected with the body, and a receiving room formed between the body and the cover for receiving the power supply therein, the bottom of the cover extends downward along the vertical downward direction to form a main post which tightly connects with the supporter; The first light plate includes an inserting portion inserted into the main post to electrically connect with the power supply, the main post includes a wiring post passing through the heat sink to electrically connect the second luminous portion with the power supply via the wiring post.

Wherein the second lampshade is integrated configuration and includes a plurality of connecting strips, a plurality of sliding recesses used for tightly connecting the second lampshade and the second baseboard, and a second gap formed between the plurality of connecting strips; the connecting strip corresponds to the first gap which is formed between the second and third baseboards when the second lampshade covers on both the second and third light plates.

The present disclosure provides the advantages as below.

The first and second luminous portions are respectively mounted on the corresponding upper and bottom sides of the heat sink to ensure the LED light simultaneously give out lights towards up and down. In addition, the heat sink is positioned between the first and second luminous portions to improve heat dissipation effects and the lifespan of the LED light.

DETAILED DESCRIPTION

Figure 1:
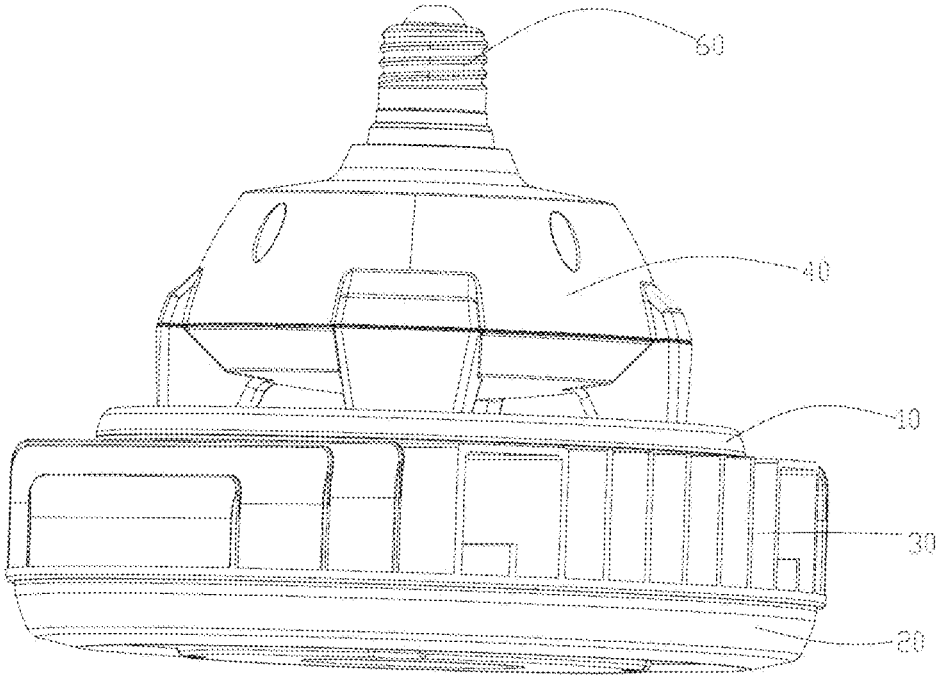
FIG. 1 is a schematic view of the LED light in accordance with an exemplary embodiment.

The disclosure is illustrated by way of example and not by way of limitation in the figures of the accompanying drawings, in which like reference numerals indicate similar elements.

Figure 2:
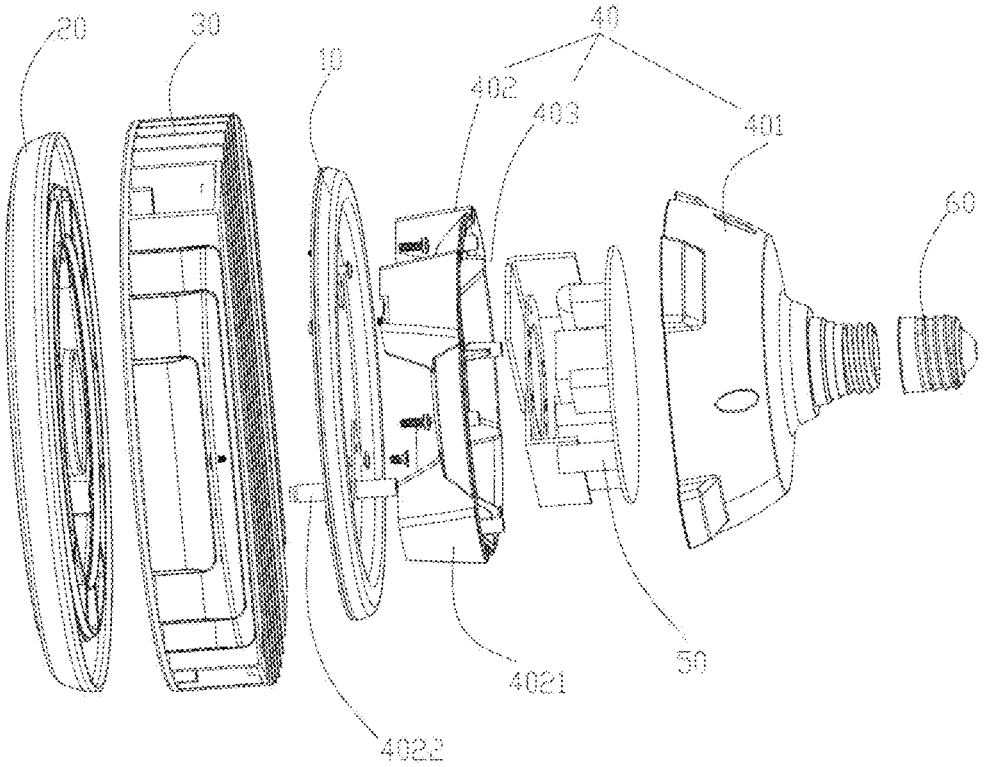
FIG. 2 is an exploded schematic view of the LED light of FIG. 1.

Referring to FIGS. 1-2, the LED light according to an exemplary embodiment includes a first luminous portion 10, a second luminous portion 20, a heat sink 30, a housing 40, a power supply 50 and a holder 60. The holder 60, the power supply 50, the first luminous portion 10 and the second luminous portion 20 are electrical connection to form a circuit branch. The first luminous portion 10 is positioned on the upper portion of the heat sink 30 and surrounds around the housing 40. The second luminous portion 20 is positioned on the bottom portion of the heat sink 30 and positioned below the first luminous portion 10. The power supply 50 is received in the housing 40, and the holder 60 electrically connects with the power supply 50. The heat sink 30 is positioned between the first luminous portion 10 and the second luminous portion 20. When the first luminous portion 10 gives out light towards a first direction, the light emitted by the first luminous portion 10 surrounds around the periphery of the housing 40. The second luminous portion 20 gives out light towards a second direction which is opposite to the first direction. In the exemplary embodiment of the present disclosure, the first direction is vertical upward and the second direction is vertical downward.

In the exemplary embodiment of the present disclosure, comparing to the ordinary LED light, the first and second luminous portions 10, 20 of the LED light of the disclosure are provided. In this way, when the first luminous portion 10 gives out light towards a first direction, the light emitted by the first luminous portion 10 surrounds around the periphery of the housing 40. The second luminous portion 20 gives out light towards a second direction which is opposite to the first direction. Thus, it is ensured that the LED light simultaneously gives out light towards up and down. Meanwhile, comparing to the traditional HID lamps (xenon lamps), the heat sink 30 is positioned between the first luminous portion 10 and the second luminous portion 20, thereby the heat sink 30 may dissipate heat generated by the first luminous portion 10 and the second luminous portion 20 so as to improve heat dissipation effects and the lifespan of the LED light.

In the exemplary embodiment of the present disclosure, the light angle of the typical LED light is 120 degree which is limited, it is not possible to simultaneously give out light towards up and down, thereby the typical LED light is not suitable for lighting in the parking lots or the garages. However, the traditional HID lamps may simultaneously give out light towards up and down, but it has poor heat dissipation, low luminous efficiency, low energy-saving and poor environmental protection, and poor lifespan. So, the LED light of the present disclosure which may simultaneously give out light towards up and down may meet the illumination requirement of the parking lots, and at the same time, the LED light of the present disclosure has the characterized by high heat dissipation effects, high energy-saving and long lifespan.

Figure 3:
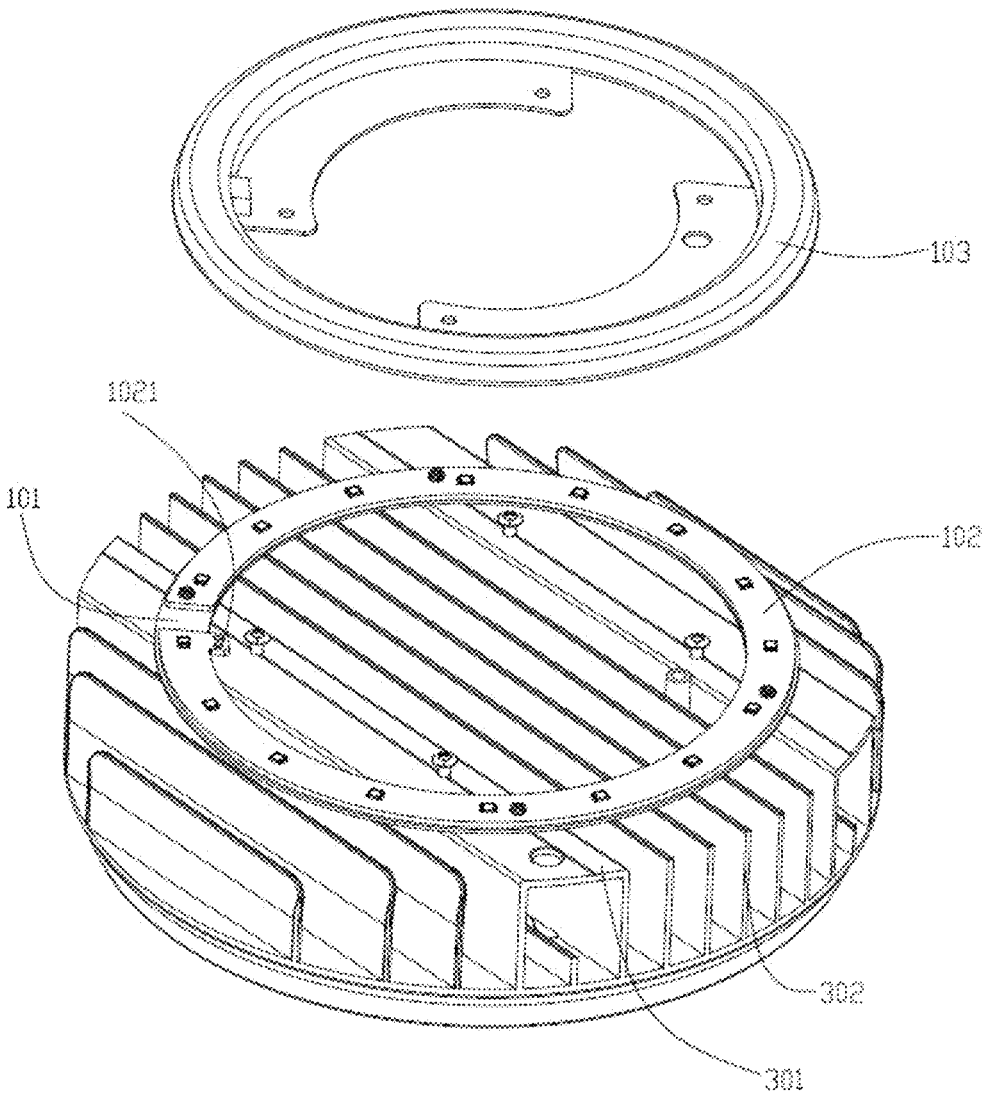
FIG. 3 is a schematic view of a heat sink and a first luminous portion of the LED light of FIG. 1.
Figure 5:
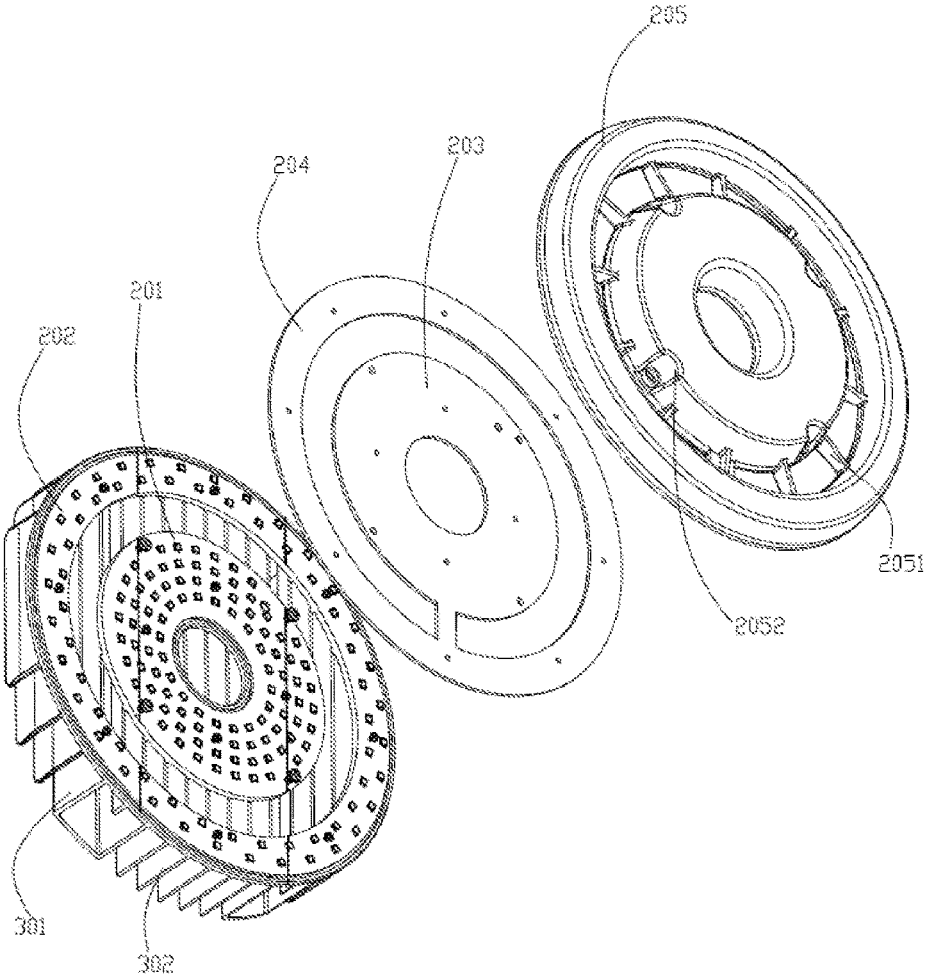
FIG. 5 is an exploded schematic view of the heat sink and the first luminous portion of the LED light of FIG. 1.

Referring to FIGS. 3 and 5, the heat sink 30 includes a supporter 301 and a plurality of cooling fins 302. The plurality of cooling fins is vertically positioned between the first luminous portion 10 and the second luminous portion 20, and the supporter 301 is positioned between the plurality of cooling fins 302.

In the exemplary embodiment of the present disclosure, the heat sink 30, through the convection of air, takes away the heat generated by the first luminous portion 10 and the second luminous portion 20. The amount of the supporter 301 is two. The two supporters 301 are positioned between the plurality of cooling fins 302. The supporter 301 is hollow inside configuration and has an inverted U-shaped. A channel (not labeled) is formed through the inside of the supporter 301. The two opposite ends of the supporter 301 in the horizontal direction are unclosed so that the air may enter the supporter 301 from the horizontal direction. The supporter 301 includes another type cooling fin (not labeled), with a short length along the horizontal direction than that of the cooling fin 302, which further increases the heat dissipation area and improves the heat dissipation performance of the LED light. The plurality of cooling fins 302 is formed parallel to each other, the length of the plurality of cooling fins 302 are different, thereby increasing the heat dissipation area and improving the heat dissipation performance of the LED light. A passageway (not labeled) is formed between every two adjacent cooling fins 302. The channel and the passageway are provided to make for the air circulation in the heat sink 30 so as to improve the heat dissipation effects. The two supporters 301 and the plurality of cooling fins 302 cooperatively surround to form a cylinder (not labeled) so as to ensure the heat dissipation area of the heat sink 30 large enough to improve the heat dissipation effects.

Furthermore, referring to FIG. 3, the first luminous portion 10 is circular ring configuration and includes a first baseboard 101, a first light plate 102 and a first lampshade 103. The first baseboard 101 is mounted on the supporter 301, the first light plate 102 with circular ring shaped and tightly connects with the first baseboard 101, and the first lampshade 103 tightly connects with the first baseboard 101 and covers on the first light plate 102.

In the exemplary embodiment of the present disclosure, the first luminous portion 10 is circular ring configuration and surrounds around the periphery of the housing 40, thereby the first luminous portion 10 does not completely cover the heat sink 30. The heat sink 30 has the cooling functional along its radial direction, thereby further improving the heat dissipation performance of the heat sink 30. Both the first light plate 102 and the first lampshade 103 are circular ring configuration, the first light plate 102 includes a plurality of first LEDs (not labeled) which emits light and generates heat when the first luminous portion 10 is powered on. The first lampshade 103 is polycarbonates (PC) transparent material and circular ring configuration. The light emitted by the first LEDs may be transmitted through the first lampshade 103. The first lampshade 103 is used to protect the first light plate 102, thereby preventing the moisture or harmful gas in the air or the micro-dust from eroding the first light plate 102 to improve the lifespan of the first light plate 102.

Furthermore, referring to FIG. 2, the housing 40 includes a body 401 and a cover 402 tightly connected with the body 401. A receiving room 403 is formed between the body 401 and the cover 402 for receiving the power supply 50 therein. The bottom of the cover 402 extends downward along the second direction to form a main post 4021 which tightly connects with the supporter 301.

In the exemplary embodiment of the present disclosure, the bottom of the cover 402 extends downward along the second direction to form the main post 4021, and the amount of the main post 4021 is four. The four main posts 4021 tightly connect with the supporter 301, thereby the housing 40 positioned above the heat sink 30 so that the housing 40 does not completely cover the heat sink 30. In this way, the area of the heat sink 30 and air convection are increased to improve the heat dissipation area of the heat sink 30. Furthermore, the four main posts 4021 are provided to separate the receiving room 403 from the heat sink 30, the heat generated by the heat sink 30 may not be transmitted to the power supply 50 which is received in the receiving room 403, thereby the power supply 50 will not be damaged by the heat, thus the lifespan of the driver of the power supply 50 is improved.

Furthermore, the first light plate 102 includes an inserting portion (not labeled) inserted into the main post 4021 to electrically connect with the power supply 50. The main post 4021 includes a wiring post 4022 passing through the heat sink 30, thereby the second luminous portion 20 electrically connecting with the power supply 50 via the wiring post 4022.

In the exemplary embodiment of the present disclosure, the inserting portion is inserted into the main post 4021 and the main post 4021 defines the wiring post 4022, the wiring line of the electrical connection between the first luminous portion 10 and the power supply 50, and the wiring line of the electrical connection between the second luminous portion 20 and the power supply 50, are more reasonable and concealed to avoid the line nudity and the safety hidden trouble.

Figure 4:
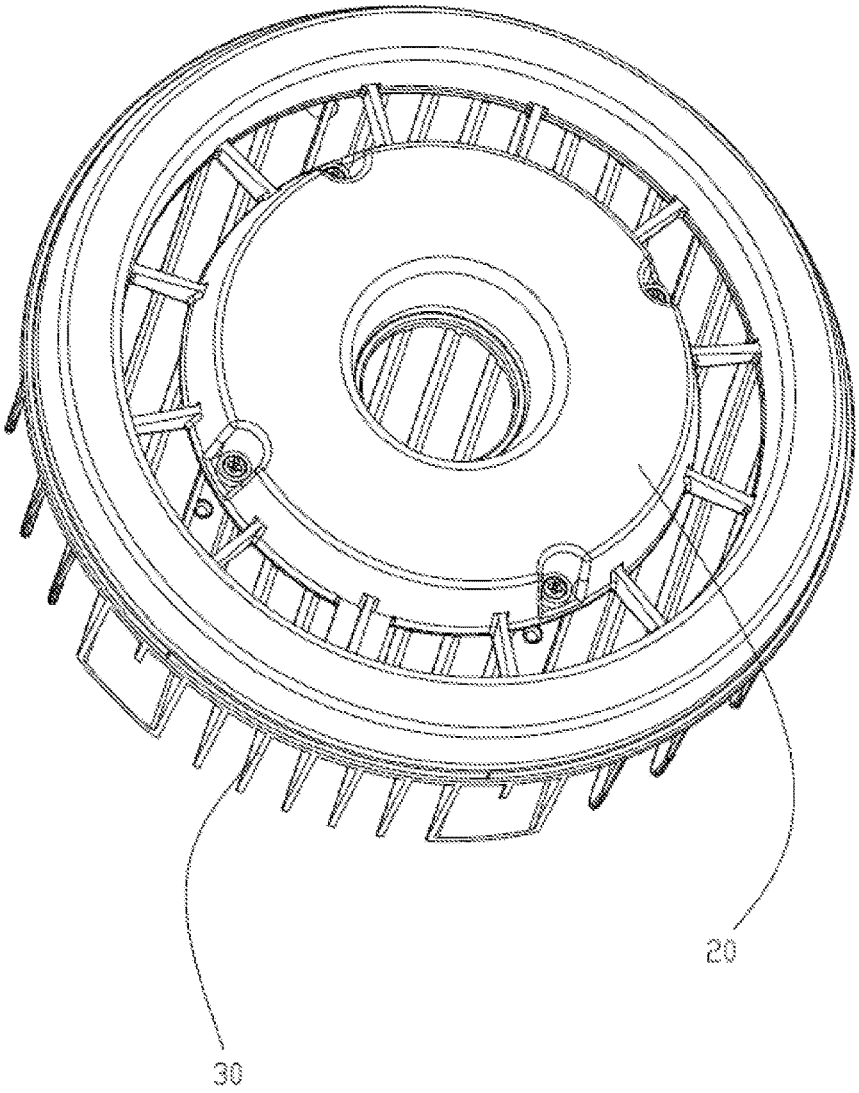
FIG. 4 is a schematic view of the heat sink and a second luminous portion of the LED light of FIG. 1 from another side.

Referring to FIGS. 4-5, the second luminous portion 20 includes a second baseboard 201, a third baseboard 202, a second light plate 203 and a third light plate 204. The second baseboard 201 is circular ring configuration and tightly connects with the supporter 301 and the plurality of cooling fins 302. The third baseboard 202 is circular ring configuration and tightly connects with the supporter 301 and the plurality of cooling fins 302. The second light plate 203 is tightly mounted on the second baseboard 201, and the third light plate 204 is tightly mounted on the third baseboard 202. The third baseboard 202 surrounds around the second baseboard 201 and a first gap is formed between the second baseboard 201 and the third baseboard 202.

In the exemplary embodiment of the present disclosure, the second baseboard 201 is circular ring configuration, correspondingly, the second light plate 203 which is tightly mounted on the second baseboard 201 is also circular ring configuration. The third baseboard 202 is circular ring configuration, correspondingly, the third light plate 204 which is tightly mounted on the third baseboard 202 is also circular ring configuration. The first gap is formed between the second baseboard 201 and the third baseboard 202. A third gap is formed between the second light plate 203 and the third light plate 204. A connecting plate connects the second light plate 203 and the third light plate 204, thereby a plurality of gaps is formed in inside of the second luminous portion 20. The second luminous portion 20 does not completely cover the heat sink 30 when the second luminous portion 20 connects with the heat sink 30, thereby the heat sink 30 may dissipate heat through the plurality of gaps defined in the second luminous portion 20 to further improve the heat dissipation performance of the heat sink 30.

In additional, the second luminous portion 20 further includes a second lampshade 205 made from polycarbonates (PC) transparent material. The second lampshade 205 is tightly mounted on the second baseboard 201 and the third baseboard 202 to cover on the second light plate 203 and the third light plate 204.

In the exemplary embodiment of the present disclosure, both the second light plate 203 and the third light plate 204 respectively include a plurality of second LEDs (not labeled). The light emitted by the second LEDs may be transmitted through the second lampshade 205. The second lampshade 205 is used to protect the second light plate 203 and the third light plate 204, thereby preventing the moisture or harmful gas in the air or the micro-dust from eroding the second and third light plates 203, 204 to improve the lifespan of the second and third light plates 203, 204.

Furthermore, the second lampshade 205 includes a plurality of connecting strips 2051 and a second gap (not labeled) is formed between the plurality of connecting strips 2051. The connecting strip 2051 corresponds to the first gap which is formed between the second and third baseboards 201, 202 when the second lampshade 205 covers on both the second light plate 203 and the third light plate 204.

In the exemplary embodiment of the present disclosure, the connecting strip 2051 is defined on the second lampshade 205, thereby the second gap is defined between the connecting strips 2051 to obtain a stable structure of the second lampshade 205.

Furthermore, the second lampshade 205 is integrated configuration and includes a plurality of sliding recesses 2052 used for tightly connecting the second lampshade 205 and the second baseboard 201.

In the exemplary embodiment of the present disclosure, the second lampshade 205 is integrated configuration so as to achieve mass production of the second lampshade 205 and reduce the production time and process cost thereof. The sliding recess 2052 is semicircular and the amount of the sliding recess 2052 is four. The four sliding recesses 2052 are arranged in the second lampshade 205 at equal intervals. The sliding recess 2052 is a concave towards the connecting strip 2051, which is used to provide the mounting bit of the fixed screw between the second lampshade 205 and the second baseboard 201.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A light emitting diode (LED) light used for a parking lot or a garage comprising:

a housing;

a first luminous portion being circular ring configuration disposed on an outer periphery of the housing;

a second luminous portion positioned below the first luminous portion;

a heat sink positioned between the first luminous portion and the second luminous portion;

a power supply received in the housing;

a holder electrically connected with the power supply; wherein the holder, the power supply, the first luminous portion and the second luminous portion are electrically connected to form a circuit branch; when the first luminous portion gives out light towards a first direction, the second luminous portion gives out light towards a second direction which is opposite to the first direction.

2. The LED light as claimed in claim 1, wherein the first direction is vertical upward and the second direction is vertical downward.

3. The LED light as claimed in claim 1, wherein the heat sink comprises a plurality of cooling fins vertically positioned between the first luminous portion and the second luminous portion, and a supporter positioned between the plurality of cooling fins, the supporter and the plurality of cooling fins surround to form a cylinder.

4. The LED light as claimed in claim 3, wherein the supporter is hollow inside configuration and a channel is formed therethrough, two opposite ports of the supporter in a horizontal direction are unclosed so as to allow air to enter the supporter from the horizontal direction; the plurality of cooling fins are formed parallel to each other, the length of the plurality of cooling fins is different and a passageway is formed between every two adjacent cooling fins.

5. The LED light as claimed in claim 3, wherein the first luminous portion comprises a first baseboard mounted on the supporter, a first light plate, with circular ring shaped, tightly connected with the first baseboard, and a first lampshade tightly connected with the first baseboard and covered on the first light plate; wherein the first light plate comprises a plurality of first LEDs which emits light and generates heat when the first luminous portion is powered on; the first lampshade is a polycarbonates (PC) transparent material and circular ring configuration.

6. The LED light as claimed in claim 5, wherein the first light plate comprises an inserting portion inserted into a main post of the housing to electrically connect with the power supply, the main post comprises a wiring post passing through the heat sink to electrically connect the second luminous portion with the power supply via the wiring post.

7. The LED light as claimed in claim 5, wherein the second luminous portion comprises a second baseboard tightly connected with the supporter and the plurality of cooling fins, a third baseboard tightly connected with the supporter and the plurality of cooling fins, a second light plate tightly mounted on the second baseboard, and a third light plate tightly mounted on the third baseboard; wherein both the second light plate and the third light plate are circular ring configuration and the third light plate comprises a plurality of second LEDs.

8. The LED light as claimed in claim 7, wherein the third baseboard surrounds around the second baseboard and a first gap is formed between the second baseboard and the third baseboard.

9. The LED light as claimed in claim 7, wherein the second luminous portion further comprises a second lampshade made from polycarbonates (PC) transparent material, the second lampshade tightly mounted on the second baseboard and the third baseboard to cover on the second light plate and the third light plate.

10. The LED light as claimed in claim 9, wherein the second lampshade comprises a plurality of connecting strips and a second gap is formed between the plurality of connecting strips, the connecting strip corresponds to a first gap which is formed between the second baseboard and the third baseboard when the second lampshade covers on both the second and third light plates.

11. The LED light as claimed in claim 9, wherein the second lampshade is integrated configuration and comprises a plurality of sliding recesses used for tightly connecting the second lampshade and the second baseboard.

12. The LED light as claimed in claim 3, wherein the housing comprises a body and a cover tightly connected with the body, and a receiving room formed between the body and the cover for receiving the power supply therein, the bottom of the cover extends downward along the second direction to form a main post which tightly connects with the supporter.

13. A light emitting diode (LED) light comprising:

a housing;

a first luminous portion being circular ring configuration disposed on an outer periphery of the housing;

a second luminous portion positioned below the first luminous portion;

a heat sink positioned between the first luminous portion and the second luminous portion;

a power supply received in the housing;

a holder electrically connected with the power supply; wherein the first luminous portion is positioned on the upper portion of the heat sink and the second luminous portion is positioned on the bottom portion of the heat sink, and the holder, the power supply, the first luminous portion and the second luminous portion are electrically connected to form a circuit branch; when the first luminous portion gives out light towards a vertical upward direction to surround around the housing, the second luminous portion gives out light towards a vertical downward direction which is opposite to the vertical upward direction.

14. The LED light as claimed in claim 13, wherein the heat sink comprises a plurality of cooling fins vertically positioned between the first luminous portion and the second luminous portion, and a supporter positioned between the plurality of cooling fins, the supporter and the plurality of cooling fins surround to form a cylinder; the supporter is hollow inside configuration and a channel is formed therethrough, two opposite ports of the supporter in a horizontal direction are unclosed so as to allow air to enter the supporter from the horizontal direction; the plurality of cooling fins are formed parallel to each other, the length of the plurality of cooling fins are different and a passageway is formed between every two adjacent cooling fins.

15. The LED light as claimed in claim 14, wherein the first luminous portion comprises a first baseboard mounted on the supporter, a first light plate, with circular ring shaped, tightly connected with the first baseboard, and a first lampshade tightly connected with the first baseboard to cover on the first light plate, wherein the first light plate comprises a plurality of first LEDs which emits light and generates heat when the first luminous portion is powered on; the first lampshade is polycarbonates (PC) transparent material and circular ring configuration.

16. The LED light as claimed in claim 15, wherein the second luminous portion comprises a second baseboard tightly connected with the supporter and the plurality of cooling fins, a third baseboard tightly connected with the supporter and the plurality of cooling fins, a second light plate tightly mounted on the second baseboard, and a third light plate tightly mounted on the third baseboard; wherein both the second and third light plates are circular ring configuration and the third light plate comprises a plurality of second LEDs; wherein the third baseboard surrounds around the second baseboard and a first gap is formed between the second and third baseboards.

17. A light emitting diode (LED) light used for a parking lot or a garage comprising:

a housing;

a first luminous portion surrounded around the housing;

a second luminous portion positioned below the first luminous portion;

a heat sink positioned between the first luminous portion and the second luminous portion;

a power supply received in the housing;

a holder electrically connected with the power supply; wherein the holder, the power supply, the first luminous portion and the second luminous portion are electrically connected to form a circuit branch; when the first luminous portion gives out light towards a first direction, the second luminous portion gives out light towards a second direction which is opposite to the first direction;

wherein the heat sink comprises a plurality of cooling fins vertically positioned between the first luminous portion and the second luminous portion, and a supporter positioned between the plurality of cooling fins, the supporter and the plurality of cooling fins surround to form a cylinder; and wherein the first luminous portion is circular ring configuration and comprises a first baseboard mounted on the supporter, a first light plate, with circular ring shaped, tightly connected with the first baseboard, and a first lampshade tightly connected with the first baseboard and covered on the first light plate; wherein the first light plate comprises a plurality of first LEDs which emits light and generates heat when the first luminous portion is powered on; the first lampshade is a polycarbonates (PC) transparent material and circular ring configuration.

18. The LED light as claimed in claim 17, wherein the housing comprises a body and a cover tightly connected with the body, and a receiving room formed between the body and the cover for receiving the power supply therein, the bottom of the cover extends downward along the second direction to form a main post which tightly connects with the supporter, the first light plate comprises an inserting portion inserted into the main post of the housing to electrically connect with the power supply, the main post comprises a wiring post passing through the heat sink to electrically connect the second luminous portion with the power supply via the wiring post.

19. The LED light as claimed in claim 17, wherein the second luminous portion comprises a second baseboard tightly connected with the supporter and the plurality of cooling fins, a third baseboard tightly connected with the supporter and the plurality of cooling fins, a second light plate tightly mounted on the second baseboard, and a third light plate tightly mounted on the third baseboard; wherein both the second light plate and the third light plate are circular ring configuration and the third light plate comprises a plurality of second LEDs; wherein the third baseboard surrounds around the second baseboard and a first gap is formed between the second and third baseboards.

20. The LED light as claimed in claim 19, wherein the second luminous portion further comprises a second lampshade tightly mounted on the second baseboard and the third baseboard to cover on the second light plate and the third light plate, the second lampshade is integrated configuration and comprises a plurality of connecting strips, a plurality of sliding recesses used for tightly connecting the second lampshade and the second baseboard, and a second gap formed between the plurality of connecting strips; the connecting strip corresponds to the first gap which is formed between the second and third baseboards when the second lampshade covers on both the second and third light plates.

* * * * *